US006524121B2

(12) United States Patent
Kanagawa

(10) Patent No.: US 6,524,121 B2
(45) **Date of Patent: *Feb. 25, 2003**

(54) SHIELD CONNECTOR AND MANUFACTURING METHOD THEREFOR

(75) Inventor: Shuichi Kanagawa, Nagoya (JP)

(73) Assignees: Autonetworks Technologies, Ltd., Nagoya (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/863,441

(22) Filed: May 24, 2001

(65) Prior Publication Data

US 2001/0055895 A1 Dec. 27, 2001

(30) Foreign Application Priority Data

Jun. 23, 2000 (JP) ..... 2000-189801

(51) Int. Cl.[7] ..... H01R 13/648
(52) U.S. Cl. ..... 439/98; 439/610; 439/95
(58) Field of Search ..... 439/98, 95, 108, 439/874, 886, 607, 101, 610

(56) References Cited

U.S. PATENT DOCUMENTS

| | | | | | |
|---|---|---|---|---|---|
| 4,349,241 | A | * | 9/1982 | Juris et al. | 439/607 |
| 4,490,283 | A | * | 12/1984 | Kleiner | 252/511 |
| 4,678,260 | A | * | 7/1987 | Gallusser et al. | 439/607 |
| 4,925,404 | A | * | 5/1990 | Dutcher | 439/607 |
| 5,049,332 | A | * | 9/1991 | Zeimer et al. | 264/104 |
| 6,053,749 | A | | 4/2000 | Masuda et al. | |
| 6,123,556 | A | * | 9/2000 | Asakura et al. | 439/874 |
| 6,261,108 | B1 | * | 7/2001 | Kanagawa et al. | 439/98 |
| 6,299,801 | B1 | * | 10/2001 | Handa et al. | 252/511 |

* cited by examiner

*Primary Examiner*—Gary Paumen
*Assistant Examiner*—Felix O. Figueroa
(74) *Attorney, Agent, or Firm*—Oliff & Berridge, PLC

(57) ABSTRACT

In a shield connector, tin or solder contained in a synthetic resin of a housing 21 closely adheres the metallic flange 22 so that the waterproofness between the metallic flange 22 and the housing 21 is secured. The shield connector of the invention does not require performing the step of applying a hot melt adhesive to the metallic flange 22, though such a step is necessary for manufacturing a conventional shield connector. The housing 21 is constituted by an electrically conductive synthetic resin. The entire housing 21 also serves as a shield member adapted to cover the end portion of an end portion of the shield wire 10.

5 Claims, 3 Drawing Sheets

SHIELD CONNECTOR AND MANUFACTURING METHOD THEREFOR

BACKGROUND OF THE INVENTION

1. Field of the Invention

The present invention relates to a shield connector provided at an end portion of a shield wire and installed in a through hole, which is formed in a mating shield wall, and a manufacturing method therefor.

2. Description of the Related Art

An example of a conventional shield connector is manufactured by passing a shield wire through a metallic flange and setting the shield wire and the metallic flange in a mold for resin molding and forming a housing by using a synthetic resin with which the mold is filled.

Meanwhile, with such a configuration, the synthetic resin housing does not closely adhere to the metallic flange, so that a space is formed therebetween. Thus, a hot melt adhesive or a liquid gasket is preliminarily applied onto a portion, which touches the housing, of the metallic flange. Thereafter, the space between the housing and the flange is filled up by performing an insert-forming process on the housing. Consequently, the waterproofness of the connector is secured. However, this method has the redundant step of applying a hot melt adhesive thereon. Thus, the management of this method is complicated. Consequently, the manufacturing cost of such connectors is high.

SUMMARY OF THE INVENTION

The invention is accomplished in view of such circumstances. Accordingly, an object of the invention is to provide a low-cost highly-waterproof shield connector and to provide a manufacturing method therefor.

To achieve the foregoing object of the invention, according to an aspect of the invention, there is provided a shield connector (hereunder referred to a first shied connector), in which a housing covering an end portion of a shield wire is provided in a through hole formed in a mating shield wall and in which a shield layer of the shield wire is electrically conducted and connected to the mating shield wall, and in which a conductor of the shield wire is maintained in a condition where the conductor is plunged into the mating shield wall. In this shield connector, a metallic flange is provided so that the shield wire passes therethrough. The housing is formed by filling a synthetic resin, which contains low-melting-point metal to thereby have electric conductivity, into a mold for resin-molding, into which the shield wire and the metallic flange are inserted. The low-melting-point metal has a melting point at which the metal and the synthetic resin melt together, and is bonded to the metallic flange.

According to an embodiment (hereunder referred to as a second shield connector) of the first shield connector of the invention, the metallic flange is plated with low-melting-point metal adapted to melt together with the synthetic resin that is in a molten state.

According to an embodiment (hereunder referred to as a third shield connector) of the first or second shield connector of the invention, the low-melting-point is tin or solder.

According to an embodiment (hereunder referred to as a fourth shield connector) of one of the first to third shield connectors of the invention, a urethane waterproof tube is formed in such a way as to cover an external sheath provided outside the shield layer of the shield wire. Moreover, a rear end portion of the housing is formed in such a way as to cover the periphery of the waterproof tube.

According to another aspect of the invention, there is provided a method (hereunder referred to as a first manufacturing method) of manufacturing a shield connector, in which a housing covering an end portion of a shield wire is provided in a through hole formed in a mating shield wall and in which a shield layer of the shield wire is electrically conducted and connected to the mating shield wall, and in which a conductor of the shield wire is maintained in a condition where the conductor is plunged into the mating shield wall. This method comprises the steps of passing a metallic flange through the shield wire, inserting the shield wire, which passes through the metallic flange, into a mold for resin-molding, filling the mold with a synthetic resin that contains low-melting-point metal to thereby have electric conductivity. In the case of this method, the low-melting-point metal is brought into a molten state, together with the synthetic resin, and bonded to the metallic flange.

According to an embodiment (hereunder referred to as a second manufacturing method) of the first manufacturing method of the invention, the metallic flange is preliminarily plated with low-melting-point metal that melts together with the synthetic resin put into a molten state.

According to an embodiment (hereunder referred to as a third manufacturing method) of the first or second manufacturing method of the invention, the metallic flange is preliminarily heated and then inserted into the mold.

According to an embodiment (hereunder referred to as a fourth manufacturing method) of the second or third manufacturing method of the invention, both the low-melting-point metal, which is contained in the synthetic resin, and the low-melting-point metal, with which the metallic flange is plated, are tin or solder.

In the Case of First Shield Connector and First Manufacturing Method of the Invention According to the first shield connector and the first manufacturing method of the invention, the low-melting-point metal contained in the synthetic resin of the housing is bonded to the metallic flange. Thus, the invention secures the waterproofness between the metallic flange and the housing. Moreover, the invention eliminates the necessity for the step of applying hot melt adhesive to the metallic flange, which is performed in the method of manufacturing the conventional shield connector. Thus, the invention can reduce the manufacturing cost of the shield connector. Moreover, the housing of the shield connector of the invention is constituted by the electrically conductive synthetic resin. Thus, the entire housing also serves as a shield member for covering an end portion of a shield wire. Consequently, the invention can reduce the number of components.

In the Case of Second Shield Connector and Second Manufacturing Method of the Invention According to the second shield connector and the second manufacturing method of the invention, both the low-melting-point metal, which is contained in the synthetic resin, and the low-melting-point metal, with which the metallic flange is plated, are bonded to each other in a molten state. Thus, the invention secures the waterproof therebetween.

In the Case of Third Shield Connector of the Invention

Shield connectors of the invention may contain tin or solder in the synthetic resin as the low-melting-point metal, similarly as the third shield connector of the invention.

In the Case of Fourth Shield Connector of the Invention

According to the fourth shield connector of the Invention, the urethane waterproof tube closely adheres to both the rear end portion of the housing and the external sheath of the shield wire. Thus, the invention can make the rear end portion of the housing waterproof.

In the Case of Third Manufacturing Method of the Invention

According to the third manufacturing method of the invention, the metallic flange is preliminarily heated. This accelerates the joining between the low-melting-point metal, with which the metallic flange is plated, and the low-melting-point metal contained in the synthetic resin filled into the mold. Thus, the invention increases the adhesiveness of the metal.

In the Case of Fourth Manufacturing Method of the Invention

According to the fourth manufacturing method of the invention, both the low-melting-point metal, which is contained in the synthetic resin filled into the mold, and the low-melting-point metal, with which the metallic flange is plated, are tin or solder. Thus, both the low-melting-point metals easily join together. This enhances the waterproofness between the housing and the metallic flange.

DETAILED DESCRIPTION OF THE PREFERRED EMBODIMENTS

Figure 1:
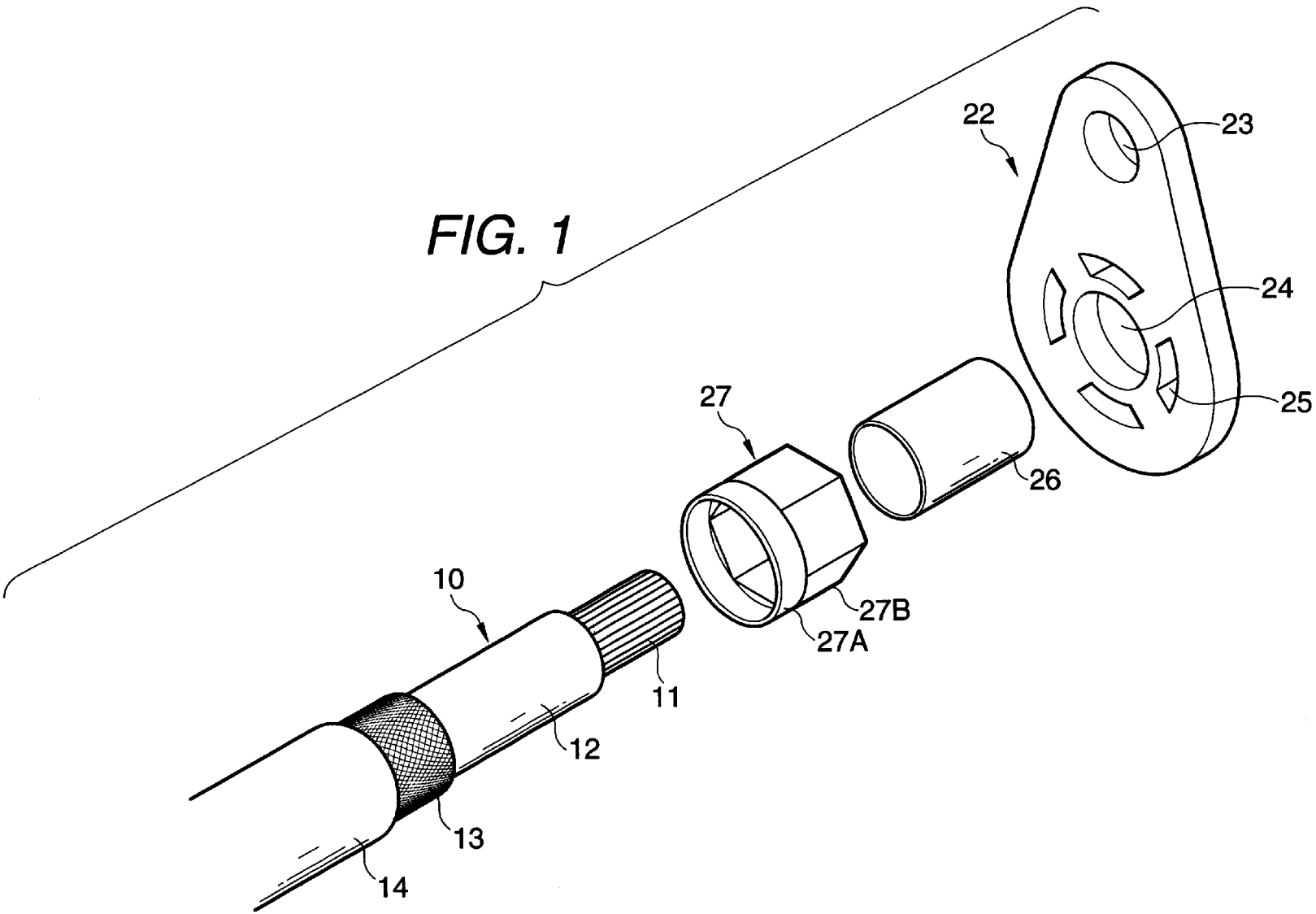
FIG. 1 is a perspective view of a metallic flange according to an embodiment of the invention.

Now, embodiments of the invention will be described hereinbelow with reference to FIGS. 1 to 3. As shown in FIG. 1, a shield wire 10 has a conductor 11, an inner insulating layer 12, a shield layer 13, and an external sheath 14, so that the conductor 11 is surrounded by the insulating layer 12, the shield layer 13, and the external sheath 14 in this order from an axial core. Further, in an end portion of the shield wire 10, the conductor 11, the inner insulating layer 12, and the shield layer 13 are sequentially exposed in a circumferentially stepped manner from a tip end thereof.

Figure 2:
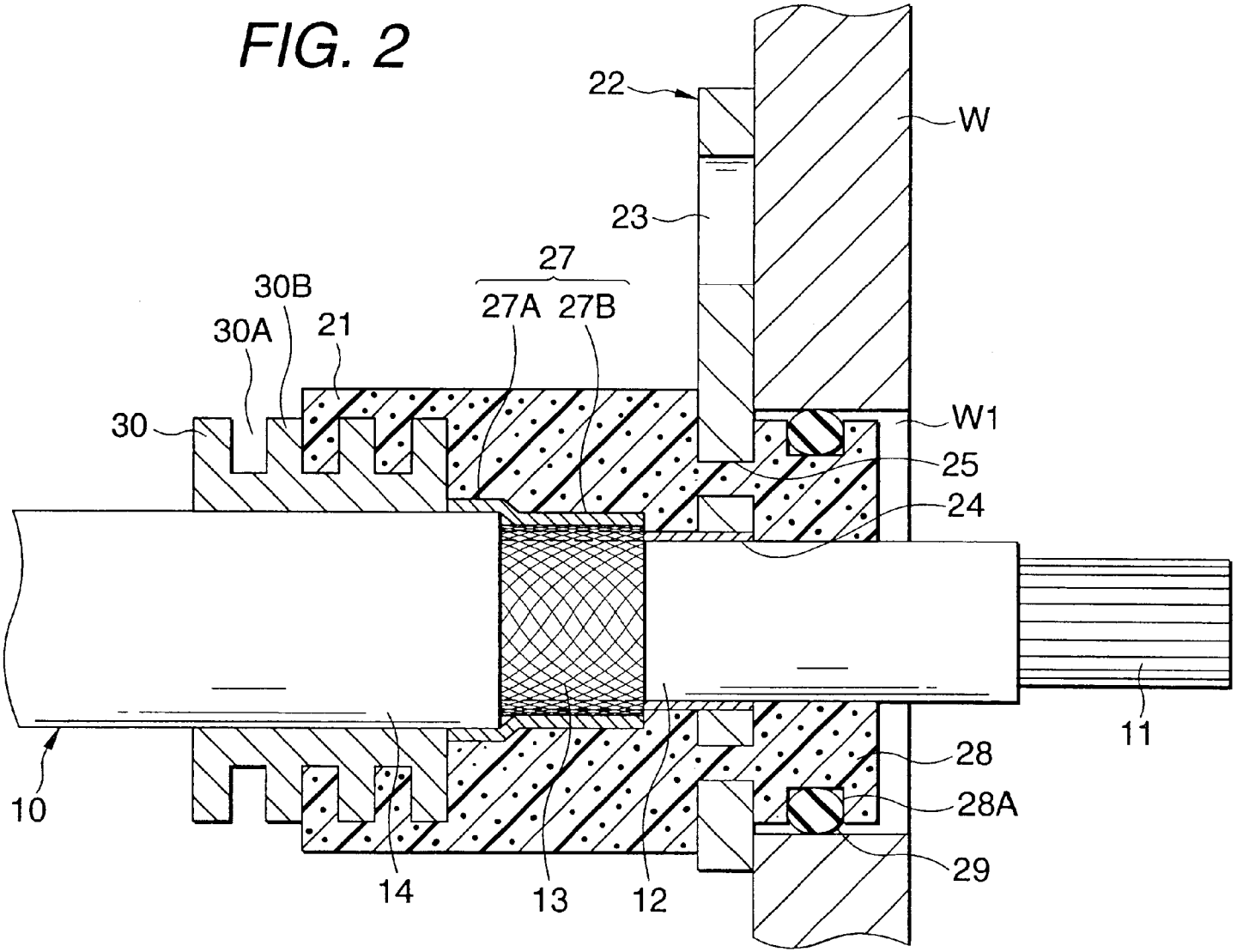
FIG. 2 is a side sectional view of a shield connector.
Figure 3:
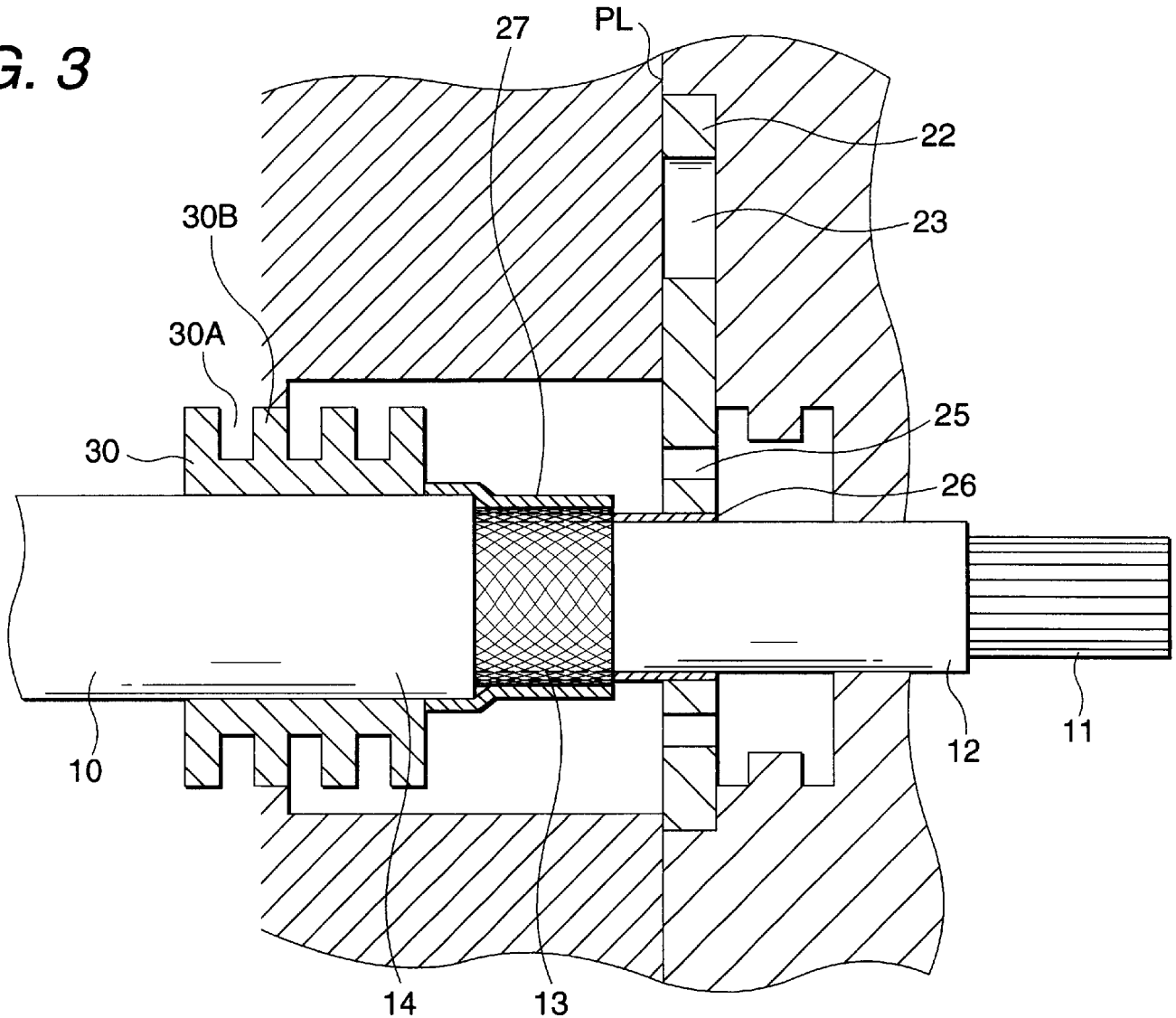
FIG. 3 is a side sectional view of a metal mold into which a shield wire is inserted.

FIG. 2 shows the shape of a section of the shield connector of this embodiment. This shield connector is integrally attached to the end portion of the shield wire 10. In this figure, reference numeral 22 designates a metallic flange, through which the shield wire 10 penetrates. The metallic flange 22 is manufactured by punching a metallic plate into a pear-like shape and has a structure in which a bolt insertion hole is formed in a part near to an end portion (that is, the top end, as viewed in FIG. 1) thereof and in which a wire insertion hole 24 is formed in a part close to the other end and in which four resin inflow holes 25 are formed at places, at which the peripheral portion of the wire insertion hole 24 is quadrisected. Moreover, the front surface of the metallic flange 22 is plated with tin. Incidentally, the melting point of tin is 231° C., while the melting point of solder is 183° C.

A metallic sleeve 26 is pressed into the wire insertion hole 24. This metallic sleeve 26 is inserted between the shield layer 13 and the inner insulating layer 12 of the shield wire 10. Moreover, a metallic press-fitting ring 27 is attached to the outer surface of the shield layer 13 by pressure. The ring 27 has a cylindrical portion 27A and a hexagonal tube 27B, which are formed in such a way as to join together in an axial direction. The cylindrical portion 27A is fitted to the outside surface of an external sheath 14 of the shield wire 10. The hexagonal tube portion 27B is fitted to the outside surface of the exposed portion of the shield layer 13. Furthermore, the shield layer 13 is sandwiched between the hexagonal tube portion 27B and the metallic sleeve 26 by caulking the portion 27B.

As shown in FIG. 2, an end of the external sheath 14 of the shield wire 10 is covered with an urethane waterproof tube 30, which is formed like a tube by inserting the shield wire 10 into a mold for urethane-molding, so that the outside surface of the external sheath is covered with a resin filled into the mold. Furthermore, the circumferential surface of the waterproof tube 30 is shaped in such a manner as to have projections and depressions. Thus, a part, which is closely attached to the housing 21, of the tube 30 is formed in such a way as to have a labyrinth structure.

Meanwhile, in the case of the shield connector of this embodiment, the housing 21 is an insert molding corresponding to the shield wire 10. More particularly, the shield wire 10 is set in the mold so that the metallic flange 22, the press-fitting ring 27, and the waterproof tube 30 are integrally fixed to one another, as illustrated in FIG. 3. At that time, a positioning pin is inserted into a concave portion 30A of the rear end of the waterproof tube 30. Moreover, the metallic flange 22 is put between mold opening faces PL of the mold. Thus, the positioning of the flange 22, the ring 27, and the tube 30 is performed. Furthermore, the metallic flange 22 is preliminarily heated together with, for instance, the inner insulating layer 12. Consequently, the temperature of the metallic flange 22 is set at about 100° C.

Then, the housing 21 is formed by filling the mold with an electrically conductive synthetic resin. More particularly, the electrically conductive synthetic resin is, for example, polybutylene terephthalate (PBT) or polyamide (PA), which contains tin or solder as the low-melting-point metal. Incidentally, a molten resin filling opening is provided to the side (that is, the right side, as viewed in FIG. 3) of a tip end portion of the shield wire 100 from the metallic flange 22. Further, the molten resin is filled into the opposite side portion of the metallic flange 22 through the resin inflow holes 25 formed in the metallic flange 22.

Then, the low-melting-point metal contained in the synthetic resin is easily bonded to the tin (or solder) of the plating applied onto the metallic flange 22 in a state in which the low-melting-point metal and the tin (or solder) melt together. Consequently, the waterproofness of the housing 21, into which the synthetic resin is solidified, and the metallic flange 22 is established. Moreover, the metallic flange 22 is preliminarily heated. Thus, the low-melting-point metal contained in the synthetic resin and the tin (or solder) easily join. After the synthetic resin is solidified into the housing 21, the housing 21 is taken out of the mold. Thus, a shield connector is completed.

The shield connector is fixed to a mating shield wall W of electric equipment with bolts (not shown) by fitting an insertion portion 28, which is provided frontwardly from the metallic flange 22 of the housing 21, into a through hole W1 formed in the wall W, and by making the metallic flange 22 abut against an opening edge of the through hole W1. Then, the metallic flange 22 is pushed against and electrically conducted and connected to the mating shield wall W. Thus, the shield layer 13 is electrically conducted and connected to the mating shield wall W. Further, an O-ring 29 is squashed between the outer circumferential surface of the insertion portion 28 and the inner circumferential surface of the through hole W1. Thus, the waterproofness of the flange 22 is secured. Furthermore, in the rear end portion of the shield connector, the urethane waterproof tube 30 closely adheres to the inner circumferential surface of the housing 21 and to the outer circumferential surface of the shield wire 10, so that the inside of the shield connector is prevented from being infiltrated by moisture from the rear end portion thereof.

Thus, according to the shield connector of the invention, the housing 21 is an insert molding corresponding to the shield wire 10. Moreover, the housing 21 is constituted by the electrically conductive synthetic resin. Thus, the entire housing 21 also serves as a shield member for covering the end portion of the shield wire 10. More enhanced electromagnetic shield effects are obtained. Furthermore, the low-melting-point metal (tin or solder) contained in the synthetic resin of the housing 21 is in a molten state and closely adheres to the metallic flange 22 and the shield layer 13. Consequently, the waterproofness of the metallic flange 22, the shield layer 13, and the housing 21 is enhanced.

Other Embodiments

The invention is not limited to the aforementioned embodiment. For example, the following embodiments are included in the technical scope of the invention. Moreover, various modifications can be made without departing from the gist of the invention.

(1) A shield connector configured so that a shield layer is electrically conducted and connected to a metallic flange 22 only through an electrically conductive housing, differently from the aforementioned embodiment in which the shield layer 13 is electrically conducted and connected to the metallic flange 22 through the metallic sleeve 26 pressed into the metallic flange 22.

(2) Another shield connector configured so that a low-melting-point metal contained in a synthetic resin of a housing differs from a low-melting-point metal with which a metallic flange is plated, differently from the aforementioned embodiment in which both the low-melting-point metal contained in the synthetic resin of the housing 21 and the low-melting-point metal, with which the metallic flange 22 is plated, are the same metal, that is, tin (or solder). Incidentally, in the case of the latter embodiment, both the low-melting-point metals can join together more easily.

What is claimed is:

1. A shield connector having a shield member, comprising:

a metallic flange, having at least a first side and a second side including a wire insertion hole through which a shield wire having a shield layer passes;

a housing for covering an end portion of the shield wire, formed of a synthetic resin containing a low-melting point metal that is electrically conductive, said housing formed on the first and second sides of the metallic flange, said low melting point metal having a melting point at which said metal and said synthetic resin melt together and bond to the metallic flange, thereby the housing also serving as the shield member of the shield connector by providing an electrical continuity between the shield layer of the shield wire and the metallic flange.

2. The shield connector according to claim 1, wherein said metallic flange is plated with low-melting-point metal adapted to melt together with said synthetic resin that is in a molten state.

3. The shield connector according to claim 1, wherein said low-melting-point metal is tin or solder.

4. The shield connector according to claim 1, further comprising:

an external sheath for covering a shield layer of a shield wire;

a urethane waterproof tube provided outside the shield layer; and wherein a rear end portion of said housing covers a periphery of the waterproof tube.

5. The shield connector according to claim 1, further comprising:

a shield layer for covering the shield wire, said shield layer electrically connected and conducted to the metallic flange through the housing.

* * * * *